United States Patent [19]

Ehnert

[11] Patent Number: 4,884,315

[45] Date of Patent: Dec. 5, 1989

[54] VACUUM CLEANER HAVING CIRCUITOUS FLOW

[76] Inventor: Richard E. Ehnert, 690 Persian Dr., Sunnyvale, Calif. 94087

[21] Appl. No.: 131,180

[22] Filed: Dec. 10, 1987

[51] Int. Cl.[4] ..... A47L 5/14

[52] U.S. Cl. ..... 15/346; 15/350

[58] Field of Search ..... 15/345, 346

[56] References Cited

U.S. PATENT DOCUMENTS

| | | | |
|---|---|---|---|
| 1,383,456 | 7/1921 | Farnsworth | 15/346 |
| 1,611,786 | 12/1926 | Serva . | |
| 2,224,202 | 12/1940 | Smellie | 15/346 |
| 2,475,808 | 7/1949 | Storm | 15/346 |
| 3,484,890 | 12/1969 | Case | 15/346 |
| 3,694,848 | 10/1972 | Alcala | 15/346 |
| 4,393,536 | 7/1983 | Tapp | 15/327 |

*Primary Examiner*—Chris K. Moore

*Attorney, Agent, or Firm*—Thomas Schneck

[57] ABSTRACT

A closed circuit vacuum apparatus having a nozzle housing which includes a cover and an exterior wall structure to form a housing interior. The housing interior is bisected by a baffle that is spaced apart from the wall structure of the nozzle housing to define an air-recirculation duct therebetween. The inner surface of the baffle defines the dimensions of an evacuation chamber. Preferably, the baffle follows the circumferential contour adjacent to the nozzle wall structure so that the air-recirculation duct completely surrounds the evacuation chamber. An evacuation port in the nozzle housing is in fluid communication with the evacuation chamber, and an exhaust port in the nozzle housing is in fluid communication with the air-recirculation duct. Particle laden air is extracted from the evacuation chamber for passage through the evacuation port to an inlet conduit. The inlet conduit is connected to a filter bag for air filtration prior to recirculation to the air-recirculation duct, whereafter a pressure differential causes the stream of air to return to the evacuation chamber. The stream of air passes through a carpet or the like to be cleaned in progressing from the air-recirculation duct to the evacuation chamber by leakage from the duct.

16 Claims, 2 Drawing Sheets

VACUUM CLEANER HAVING CIRCUITOUS FLOW

TECHNICAL FIELD

The present invention relates to vacuum cleaners for carpets and the like.

BACKGROUND ART

In most vacuum cleaners, air is drawn into the apparatus and then released through the walls of a filter bag or through the back end of a metal canister. Even if a filter is fairly efficient, a small fraction of dirt and dust particles escape through the filter bag walls or from the canister. Moreover, as air is blown out through the bag or from the canister, dirt and dust particles adjacent to the area of release are disturbed and lifted into the atmosphere.

In certain industrial applications it is imperative that the quantity of particles within a room atmosphere be kept to a minimum. A cleaning apparatus which increases, even temporarily, the quantity of airborne particles may be harmful in these applications. A not insignificant number of persons suffer from a hypersensitivity to dust particles or suffer from other allergies which are affected by an increase in airborne particles. For example, a person bothered by hayfever will suffer discomfort as a result of an apparatus causing settled particles to become airborne.

Vacuum cleaners which recirculate air back into the vacuum system are known. U.S. Pat. Nos. 4,393,536 to Tapp and 3,694,848 to Alcala teach vacuum cleaners which provide some recirculation of air flow through the system in order to increase cleaning efficiency by directing a jet blast at a carpet. The jet blast elevates dirt from the carpet, whereafter the stream of air is caused to reenter the system. In the Alcala device, the suction forces surround jet nozzles except where the jets of air enter a rug. Tapp teaches a jet blast which is rearward and spaced apart from the suction forces.

It is an object of the present invention to provide a vacuum cleaning device which directs air back into the vacuum system after filtration and which does so to a greater degree than what is accomplished by prior art recirculation systems. It is a further object to utilize the recirculation of air to enhance the cleaning efficiency of a vacuum device.

DISCLOSURE OF THE INVENTION

The above objects have been met by a device having a closed vacuum system in which the filtered air is driven into an air-recirculation duct loop that provides a circumferential component of force to the filtered air which is then directed radially inwardly to an evacuation chamber. Air leakage from the duct into the underlying carpet or the like agitates particles which are drawn into the air stream which is pulled into a central evacuation zone.

The vacuum apparatus includes a nozzle housing having a cover and an exterior wall structure to form a housing interior. The housing interior is divided by a circumferential baffle that is spaced apart from the wall structure of the nozzle housing to define a peripheral air-recirculation duct. Preferably the baffle follows the contour of the wall structure and completely surrounds the evacuation chamber. The inner surface of the baffle defines the dimensions of the evacuation chamber.

An air inlet conduit is connected to an evacuation port in the evacuation chamber. A motor-driven suction fan extracts air from the evacuation chamber via the inlet conduit. The particle laden air from the evacuation chamber is then passed through an air filtration and particle collection bag which removes dirt and dust from the stream of air. The filtered air is directed into the air-recirculation duct at a trail end of the vacuum cleaning device.

Upon entrance into the air-recirculation duct, the stream of filtered air is circulated in a circumferential path, with leakage into the carpet or material being cleaned about the entire periphery of the nozzle while suction is applied from inside the circumferential path. The filtered air will therefore seek to return to the evacuation chamber. The baffle is an imperforate wall having a vertical extension substantially similar to the wall structure of the nozzle housing. To reenter the evacuation chamber the filtered air must pass under the baffle, and in doing so will pass through the carpet to be cleaned. Passage of air through the carpet increases the cleaning efficiency of the device because particulate matter in the carpet is loosened and captured.

In a second embodiment, for use in the vacuuming of long shag carpeting or rugs, the baffle does not extend as far in a downward direction as the walls of the nozzle housing. In the nap of the carpeting, however, the stream of filtered air is still caused to pass through the carpeting. It is possible to limit the air-recirculation duct to three sides of the evacuation chamber, but with such a limitation the duct must progress along the opposed lateral ends and the lead end of the vacuum device with extraction from the evacuation chamber being at the trail end. Thus, as the vacuum device is moved in a forward direction, the air within the evacuation chamber is forced upward to discourage the passage of air beneath the device.

An advantage of the present invention is that the escape of air from the vacuum system is reduced while particle capture is enhanced. Another advantage is that by causing the filtered air to be injected into a carpet at the periphery of the nozzle, the full nozzle dimensions are used, so that the cleaning efficiency of the device is improved.

BEST MODE FOR CARRYING OUT THE INVENTION

Figures 1, 2:
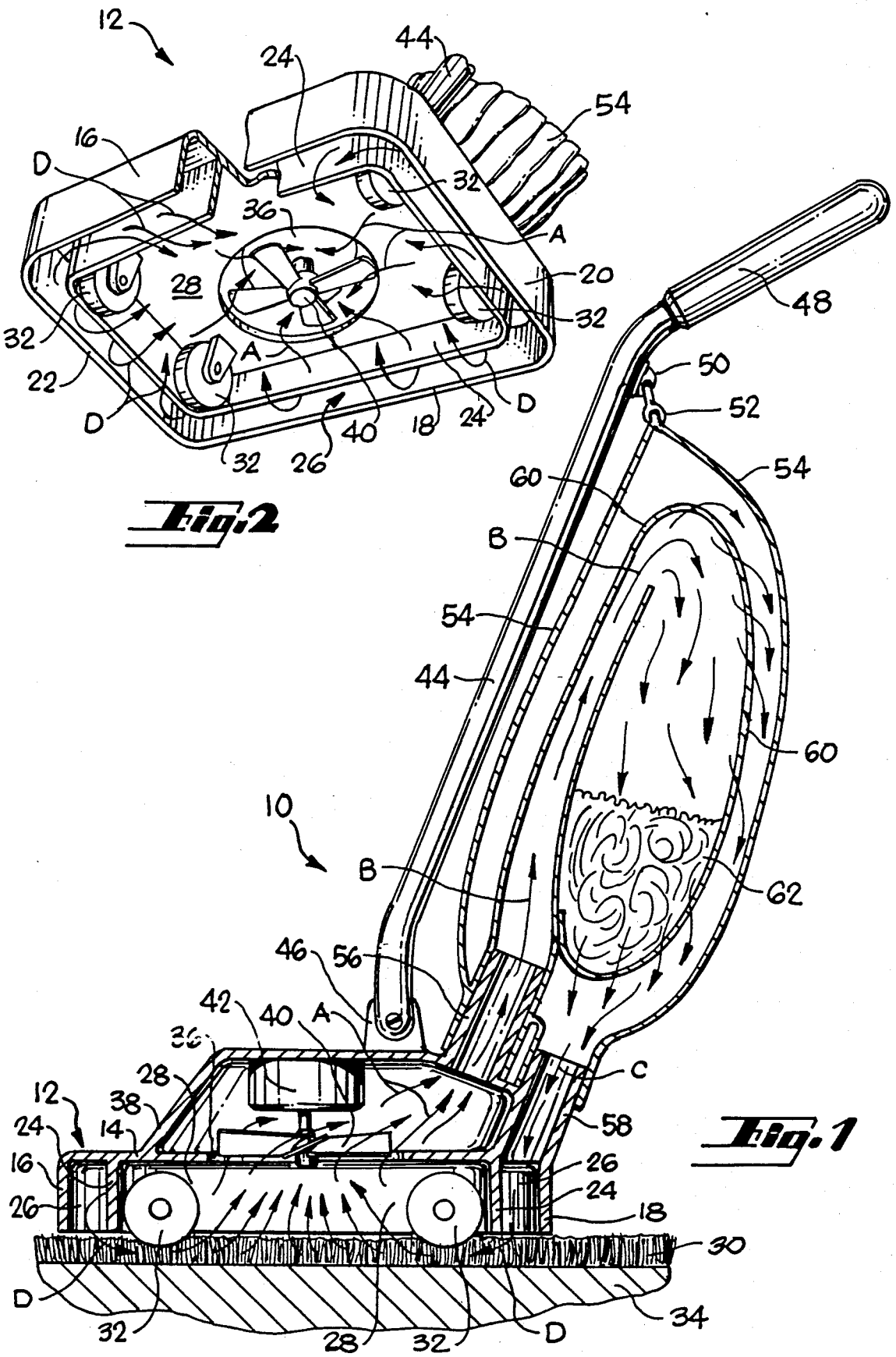
FIG. 1 is a side sectional view of an upright vacuum cleaner in accord with the present invention.
FIG. 2 is a bottom perspective, partially cutaway, view of the nozzle housing of FIG. 1.

With reference to FIGS. 1 and 2, an upright vacuum cleaning device 10 includes a nozzle housing 12 having a cover 14 and walls 16, 18, 20 and 22. A continuous baffle 24 is substantially equidistantly spaced apart from each wall 16-22 to define an air-recirculation duct 26 therebetween. The inner surface of the baffle 24 forms the dimensions of a central evacuation chamber 28. The nozzle housing 12 is supported above a carpet 30 by four surface engaging wheels 32. FIG. 1 shows the carpet 30 fixed to a floor surface 34.

An evacuation port 36 at the top of the nozzle housing 12 permits fluid communication between the evacuation chamber 28 and the interior of a fan shield 38. The radius of the evacuation port 36 is slightly larger than the radial extension of the blades of a suction fan 40. The suction fan 40 is rotatably driven by an electric motor 42. Rotation of the suction fan 40 extracts air from the evacuation chamber 28, as shown by Arrows A.

A rigid tube handle 44 is pivotally connected to a bracket 46 attached to the fan shield 38. The tube handle 44 is angled at the upper region and fitted with a grip 48 to facilitate operator movement of the upright vacuum cleaning device 10. To the rear of the tube handle 44 is a hook 50 having an eyelet which detachably receives a clip 52. A portion of a flexible air-impervious sack 54 is pinch fit into the end of the clip 52. The bottom of the flexible sack 54 is open-ended and slides snugly over an air intake hollow conduit 56 at one side and an exhaust port conduit 58 at the other side.

As indicated by Arrows A, suction fan 40 forces the particle laden air from the evacuation chamber 28 into the enclosed area of the fan shield 38, whereafter the air enters the air intake conduit 56. The particle laden air is then received by an air filtration and particle collection bag 60, as shown by Arrows B. The bag 60 permits passage of air, but filters the dirt and dust particles from the air. The opening to the bag 60 is snug fit about the air intake conduit 56 so that the bag may be released and emptied after an accumulation 62 of dirt and dust particles has been collected. The filtered air passes to the exhaust port conduit 58, indicated by Arrows C, whereupon the air progresses to the air-recirculation duct 26.

Passage from the exhaust port conduit 58 to the circumferential air-recirculation duct 26 imparts a horizontal component to the force of the movement of filtered air with leakage occuring into the material being cleaned. The circumferential stream of filtered air is pushed into the material, but then pulled out by the suction fan. There is little tendency for the air to escape from the duct 26 into the atmosphere surrounding the vacuum cleaning device 10. The pneumatic pressure differential between the duct 26, the material being cleaned and the evacuation chamber 28 is considerable, as the suction fan 40 displaces air from the material and the evacuation chamber at the same time that air is entering the duct 26. As is indicated by Arrows D, the filtered air within the air-recirculation duct 26 is therefore drawn under the baffle 24 into the evacuation chamber 28. In this manner, the vacuum cleaning device 10 is a closed vacuum system with respect to the air that progresses through the device.

The walls 16–22 and the baffle 24 of the nozzle housing 12 are vertically coextensive and have a downward reach which is at least close to a carpet 30 to be cleaned. Consequently, the radially inward flow of filtered air from the air-recirculation duct 26 must pass through the carpet 30. In doing so the movement of air provides a pneumatic agitation process which increases the cleaning efficiency of the vacuum cleaning device 10. The pneumatic agitation aids in removing settled particles from the carpet 30 and causes the particles to become airborne as the agitated air molecules are displaced from the carpet into the evacuation chamber 28 by the suction fan 40.

Figure 3:
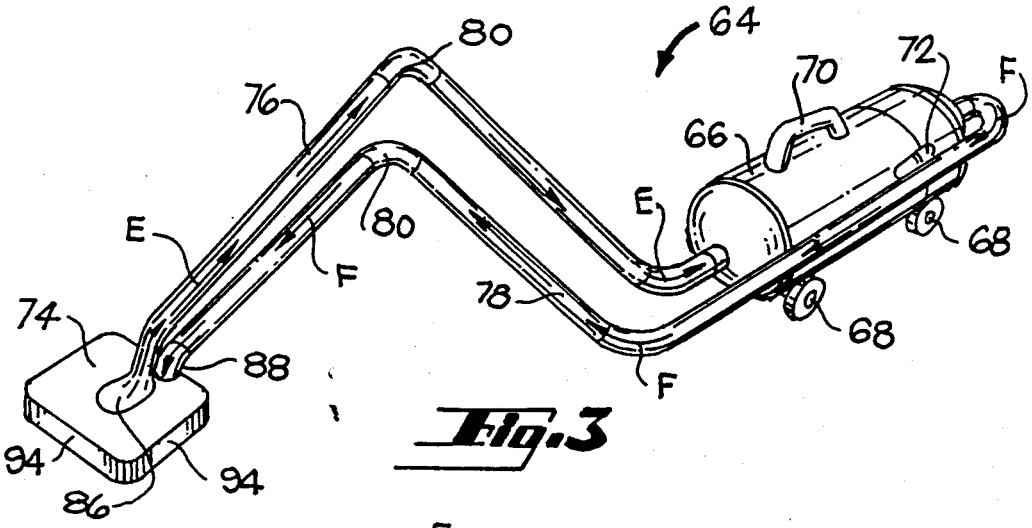
FIG. 3 is a perspective view of a canister-type vacuum cleaner in accord with the present invention.
Figure 4:
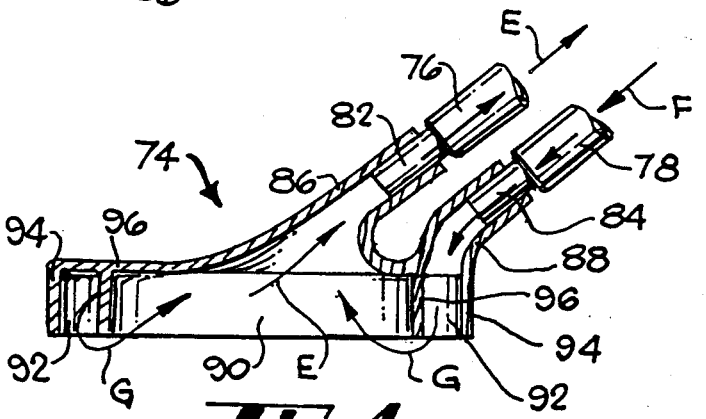
FIG. 4 is a side sectional view of the nozzle housing of FIG. 3.

Referring now to FIGS. 3 and 4, a canister-type vacuum cleaning unit 64 is shown. The canister 66 includes a plurality of surface engaging wheels 68 and a carrying handle 70. The canister 66 houses a vacuum-creating assembly and an air filtration and particle collection bag much like the upright device 10 of FIG. 1. Latches 72 on the opposite sides of the canister 66 may be released to permit emptying or replacement of the air filtration and particle collection bag.

A nozzle housing 74 is operatively connected to the vacuum-creating assembly and the air filtration and particle collection bag via an intake hose 76 and an exhaust hose 78. The hoses 76 and 78 are typically bifurcated units, with a rigid portion distal the canister joined at an elbow member 80 to a flexible portion which is attached to the canister 66. The hoses 76 and 78 each have end segments 82 and 84, respectively, of a reduced diameter which are press-fit to the nozzle housing 74. The end segment 82 of the intake hose is received within an evacuation port 86, while the end segment 84 of the exhaust hose is attached to an exhaust port 88. Because less mass must be displaced in moving the nozzle housing 74 of the canister-type unit than what is displaced in horizontal movement of an upright unit, the nozzle housing 74 does not require surface engaging wheels.

The operation of the canister-type unit 64 is substantially identical to that of the device of FIG. 1. Suction is provided by the canister 66 to remove particle laden air from an evacuation chamber 90 of the nozzle housing 74. Arrows E demonstrate the progression of an air stream from the nozzle housing 74 to the canister 66. Within the canister 66 the stream of air is filtered to remove dirt and dust particles. The filtered air is then recirculated to the nozzle housing 74 via the exhaust hose 78, as shown by Arrows F. From the exhaust hose 78 the filtered stream of air enters an air-recirculation duct 92 which is defined by walls 94 of the nozzle housing and a baffle 96. Again, the pressure differential between the duct 92 and evacuation chamber 90 causes the filtered air to reenter the evacuation chamber. Air reentry into the evacuation chamber 90 may take place only by movement under the baffle 96, as shown by Arrows G, and as a result a pneumatic agitation process takes place to enhance the cleaning efficiency of the unit 64.

Figure 5:
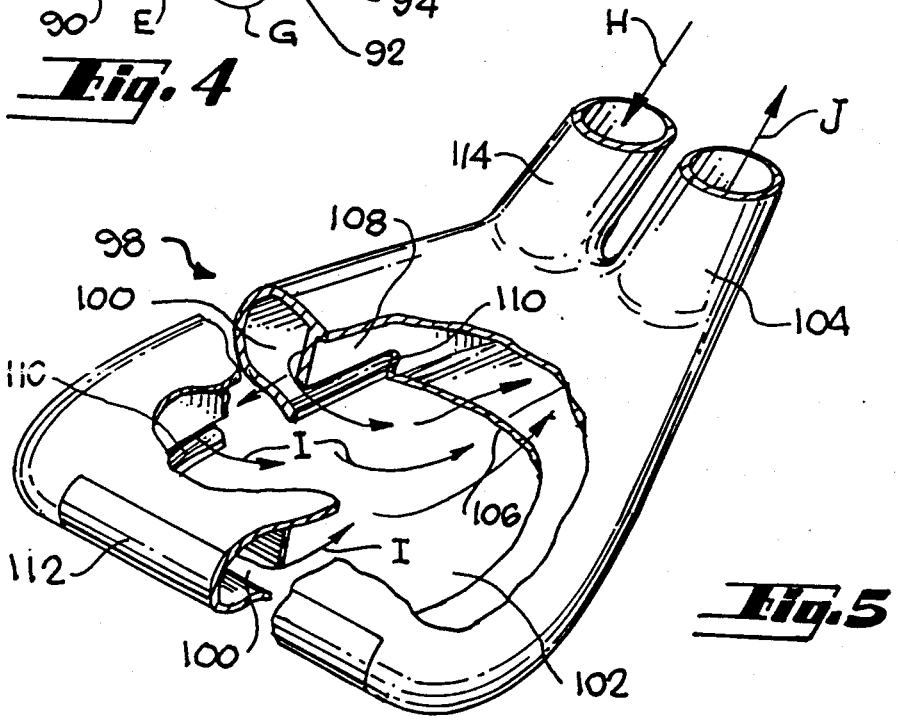
FIG. 5 is a top perspective, partially cutaway, view of a second embodiment of the nozzle housing of FIG. 3.

FIG. 5 illustrates a second embodiment of the nozzle housing 74 of FIG. 3. In FIG. 5 the nozzle housing 98 includes an air-recirculation duct 100 which encloses an evacuation chamber 102 on three sides, rather than four. While the air-recirculation duct 100 does not extend across the trail end of the nozzle housing 98, the efficiency in returning air to the vacuum system is not lessened because the evacuation port 104 is positioned at the trail end of the nozzle housing. Consequently, air within the evacuation chamber 102 is displaced upwardly prior to the trail end lip 106 of the evacuation chamber.

The nozzle housing 98 is best suited for use in the cleaning of a long fiber shag carpet, not shown. To this end, a baffle 108 is constructed to leave a gap 110 between the vertical descent of the baffle 108 and the descent of the housing wall 112. The major portion of the nozzle housing's mass is supported by contact of the housing wall structure 112 with the shag carpet. The gap 110 should also submerge into the carpet, so that a stream of air progressing from the air-recirculation duct 100 to the evacuation chamber 102 must pass through the carpet to provide a pneumatic agitation process. The path of a stream of air from a canister 66 is, therefore, into the nozzle housing 98 via an exhaust port 114, as shown by Arrow H, and forward to the gap 110 between the baffle 108 and the wall structure 112. From the gap 110 the stream of air passes through a carpet and into an evacuation chamber 102. Arrows I demonstrate the passage of air into the evacuation chamber 102, while Arrow J indicates the exit of air from the evacuation chamber through the evacuation port 104 for return to the canister 66.

In operation, all of the embodiments provide a vacuum system that recirculates air into the system after the air has been filtered to remove dirt and dust particles. Moreover, all of the embodiments provide an air-recirculation duct which is a circumferential path about the periphery of a nozzle, radially outward of an evacuation chamber. Finally, an air agitation process for enhancing the cleaning efficiency of the system is provided by including air leakage through the carpet to be cleaned as part of the circuitous path through the system.

I claim:

1. A closed circuit vacuum cleaning apparatus comprising, a nozzle housing having a cover portion and a wall portion downwardly depending from said cover portion, said wall portion having an interior surface and having a leading and a trailing end and opposed sides to form an enclosure having an open bottom, a downwardly extending baffle spaced apart from said internal surface of the wall portion along said leading and trailing end and said sides to define an air-recirculation duct therebetween, said baffle further defining an evacuation chamber surrounded by said air-recirculation duct, an evacuation port in said nozzle housing in fluid communication with said evacuation chamber, an exhaust port in said nozzle housing in fluid communication with said air-recirculation duct, conduit means for providing an imperforate fluid connection of said evacuation port with said exhaust port external of said nozzle housing, said conduit means including a filtration means for air filtration and particle collection, and vacuum means operatively associated with said conduit means for pressurizing air from said evacuation chamber to said air-recirculation duct via said filtration means.

2. The apparatus of claim 1 wherein said baffle extends downwardly from said cover portion of the nozzle housing within said wall portion of the nozzle housing, said baffle surrounding said evacuation chamber such that the volume defined by said spacing apart of the baffle and the wall portion circumscribes said evacuation chamber.

3. The apparatus of claim 1 wherein said vacuum means is a motor-driven fan of an upright vacuum cleaner apparatus and said nozzle housing includes a plurality of surface engaging wheels.

4. The apparatus of claim 1 wherein said baffle has a downward reach which is substantially coextensive with said wall portion of the nozzle housing and said exhaust port is positioned at least proximate the trailing end of said wall portion.

5. The apparatus of claim 1 wherein said vacuum means and said filtration means are housed in a canister-type unit operatively linked to said nozzle housing by said conduit means.

6. A vacuum apparatus for the cleaning of carpets, comprising, a housing having a cover and downwardly depending walls to combine with a carpet to be cleaned to form an enclosed volume, said housing having opposed lateral ends and a trailing and leading end, a baffle extending downwardly from said cover for at least close engagement with said carpet, said baffle spaced apart from said walls of the housing on said trailing, leading and lateral ends to divide said enclosed volume into an air-recirculation duct and an evacuation chamber, said air-recirculation duct defined by spacing between said baffle and said walls of the housing to circumscribe said evacuation chamber, an evacuation port in said housing in fluid communication with said evacuation chamber, an exhaust port in said housing in communication with said air-recirculation duct, conduit means having a first end attached to said evacuation port and having a second end attached to said exhaust port for conducting air from said evacuation port to said exhaust port external said housing, filtration means operatively associated with said conduit means for filtering air progressing through said conduit means, and air pressurizing means operatively associated with said conduit means for driving air from said evacuation chamber into said air-recirculating duct via said conduit means.

7. The apparatus of claim 6 wherein said baffle is substantially coextensive with said walls of the housing in a vertically descending direction from said cover.

8. The apparatus of claim 6 wherein said air pressurizing means is a motor-driven fan.

9. The apparatus of claim 6 wherein said filtration means is an air filtration and particle collection bay.

10. The apparatus of claim 6 further comprising a plurality of carpet engaging wheels fixed to said housing.

11. A closed circuit vacuum cleaning apparatus comprising, a nozzle housing having an external wall structure to define a housing interior having an open bottom, said housing having a downwardly depending baffle dividing said housing interior into a central evacuation chamber and continuous air-recirculation duct about the entire periphery of said evacuation chamber, an evacuation port in said nozzle housing in direct communication with said central evacuation chamber, an exhaust port in said nozzle housing in fluid communication with said duct, a first conduit having a first end fit to said evacuation port and having a second end, filtration means attached to said second end of the first conduit for filtering air passing from said first conduit, a second conduit having a first end in fluid communication with said filtration means and having a second end attached to said exhaust port, and vacuum means for vacuum conveying a recirculating stream of air from said evacuation chamber to said duct via said first and second conduits and said filtration means.

12. The apparatus of claim 11 wherein said nozzle housing interior is divided by a downwardly extending baffle having a lower reach substantially flush with said external wall structure of the nozzle housing.

13. The apparatus of claim 11 wherein said filtration means is an air filtration and particle collection bag.

14. The apparatus of claim 11 wherein said vacuum means includes a motor-driven fan.

15. The apparatus of claim 11 further comprising surface engaging wheels.

16. The apparatus of claim 11 wherein nozzle housing has opposed trailing and leading ends, said exhaust port being positioned at said trailing end.

* * * * *